US009446613B2

(12) United States Patent
Nakano et al.

(10) Patent No.: US 9,446,613 B2
(45) Date of Patent: Sep. 20, 2016

(54) MEDIUM SUPPORTING DEVICE AND LIQUID EJECTING APPARATUS

(71) Applicant: SEIKO EPSON CORPORATION, Tokyo (JP)

(72) Inventors: Shuichiro Nakano, Matsumoto (JP); Osamu Hara, Matsumoto (JP); Eiji Kumai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/629,037

(22) Filed: Feb. 23, 2015

(65) Prior Publication Data

US 2015/0239267 A1 Aug. 27, 2015

(30) Foreign Application Priority Data

Feb. 27, 2014 (JP) ..... 2014-036404

(51) Int. Cl.
*B41J 15/16* (2006.01)
*B41J 11/00* (2006.01)

(52) U.S. Cl.
CPC ..... *B41J 15/16* (2013.01); *B41J 11/002* (2013.01)

(58) Field of Classification Search
CPC ..... B41J 15/16; B41J 11/002
USPC ..... 347/102
See application file for complete search history.

(56) References Cited

U.S. PATENT DOCUMENTS 6,390,618 B1 * 5/2002 Wotton ..... B41J 11/002 347/102
2006/0007292 A1 * 1/2006 Ohmori ..... B26F 1/3806 347/104
2008/0239049 A1 * 10/2008 Sakano ..... B41J 13/02 347/104
2012/0062641 A1 * 3/2012 DeJong ..... B41J 15/16 347/19

FOREIGN PATENT DOCUMENTS

JP 10-217572 8/1998
JP 2000-075773 3/2000

* cited by examiner

*Primary Examiner* — Erica Lin
*Assistant Examiner* — Alexander D Shenderov
(74) *Attorney, Agent, or Firm* — Workman Nydegger

(57) ABSTRACT

A medium supporting device includes a flexible medium supporting section that supports a medium, a supporting base that supports the medium supporting section in contact with a first contact section and a second contact section, and a tension applying section that applies tension to the medium supporting section between the first contact section and the second contact section. The first contact section and the second contact section extend in a cross direction, intersecting with the tension applying direction.

12 Claims, 12 Drawing Sheets

MEDIUM SUPPORTING DEVICE AND LIQUID EJECTING APPARATUS

BACKGROUND

1. Technical Field

The present invention relates to a medium supporting device and a liquid ejecting apparatus.

2. Related Art

Medium supporting devices provided with a medium supporting section that supports a medium, and liquid ejecting apparatuses provided with such a medium supporting device, have previously been employed.

For example, JP-A-10-217572 describes an ink jet recording apparatus including a mesh member serving as a medium supporting section in the vicinity of where a heater, serving as a heating section, is provided. The ink jet recording apparatus allows water vapor to escape to outside through the mesh member.

Moreover, for example, JP-A-2000-75773 describes a recording apparatus that places a toner image transferred onto a transfer medium, serving as a recording medium, supported by a sling as a medium supporting section, in contact with a heating roller, corresponding to a heating section. Water vapor is then dispersed through the sling.

JP-A-10-217572 and JP-A-2000-75773 are examples of related art.

However, hitherto in medium supporting devices with flexible medium supporting sections, sometimes the medium supporting section has supported the medium in a deformed state. Depending on the usage of the medium supporting device, issues sometimes arise due to the medium supporting section supporting the medium in a deformed state.

JP-A-10-217572 and JP-A-2000-75773 make no reference to suppressing the medium supporting section from supporting the medium in a deformed state, and do not describe configurations that suppress the medium supporting section from supporting the medium in a deformed state. There is accordingly a possibility of issues arising, such as medium transport issues.

SUMMARY

An advantage of some aspects of the invention is that a flexible medium supporting section is suppressed from supporting a medium in a deformed state.

A medium supporting device of a first aspect of the invention includes a flexible medium supporting section that supports a medium, a supporting base that supports the medium supporting section in contact with a first contact section and a second contact section, and a tension applying section that applies tension to the medium supporting section between the first contact section and the second contact section. The first contact section and the second contact section extend in a cross direction, intersecting with the tension applying direction.

According to the present aspect, the flexible medium supporting section is supported at the supporting base in a state applied with tension between the first contact section and the second contact section that extend in the cross direction. Since the first contact section and the second contact section extend in the cross direction, the medium supporting section contacts the first contact section and the second contact section and is applied with tension at a straight line, or a flat plane, extending in the cross direction. It is thereby possible to configure a flat medium support face on the medium supporting section. This thereby enables the medium supporting section to be suppressed from supporting the medium in a deformed state.

It is preferable that the tension applying section include elastic members provided in a row along the cross direction.

Accordingly, the tension applying section includes elastic members provided in a row along the cross direction. This thereby enables a configuration in which the medium supporting section is tensioned by the elastic members over a wide range in the cross direction, enabling the tension applying section capable of suppressing deformation of the medium supporting section to be configured simply and at low cost.

It is preferable that the medium supporting device further include a reinforcement member extending along the cross direction, wherein the elastic members are configured capable of applying tension to the medium supporting section by tensioning the medium supporting section together with the reinforcement member.

Accordingly, tension is applied to the medium supporting section by the elastic members tensioning the medium supporting section together with the reinforcement member. This makes it possible to tension the medium supporting section with force uniform along the cross direction using the elastic members, enabling a flat medium support face to be efficiently configured on the medium supporting section. This thereby enables the medium supporting section to be effectively suppressed from supporting the medium in a deformed state.

It is preferable that a configuration member configuring at least one of the first contact section and the second contact section be formed in a circular cylinder shape extending along the cross direction.

Accordingly, the configuration member configuring the at least one of the first contact section or the second contact section is formed in a circular cylinder shape extending along the cross direction. The medium supporting section accordingly contacts the at least one of the first contact section and the second contact section at a curved face of the circular cylinder shape, thereby suppressing contact with an acute angled portion or the like that is liable to generate wear. This thereby enables wear of the medium supporting section to be suppressed.

It is preferable that the medium supporting section have a mesh form.

The mesh form medium supporting section is readily deformable, however the present aspect enables the medium supporting section to be configured with the flat medium support face on the medium supporting section by applying tension to the medium supporting section between the first contact section and the second contact section, thereby enabling the medium supporting section to be suppressed from supporting the recording medium in a deformed state.

A liquid ejecting apparatus of a second aspect of the invention includes a transporting section that transports the medium, a liquid ejecting section that ejects liquid onto the medium being transported by the transporting section, and the medium supporting device of any one of the above medium supporting devices that uses the medium supporting section to support the medium onto which the liquid has been ejected. The tension applying direction is a direction along the transporting direction of the medium.

According to the present aspect, the tension applying direction is a direction along the transporting direction of the medium, thereby enabling deformation, particularly extending along the cross direction to the transporting direction, to be effectively suppressed from arising in the medium supporting section.

It is preferable that the liquid ejecting apparatus further include a heating section capable of heating the medium that is supported by the medium supporting section and onto which the liquid is ejected, wherein the tension applying section applies tension from the downstream side in the transporting direction of the medium.

Accordingly, the tension applying section applies tension from the downstream side in the transporting direction of the medium. Namely, the tension applying section is provided at the transporting direction downstream side of the medium supporting section. This thereby enables condensation to be suppressed from developing on the tension applying section.

It is preferable that the lengths in the cross direction of the first contact section and the second contact section be a length in the cross direction over which the liquid is ejectable by the liquid ejecting section, or a longer length.

Accordingly, the lengths in the cross direction of the first contact section and the second contact section are the length in the cross direction over which the liquid is ejectable by the liquid ejecting section, or a longer length. Namely, the lengths of the first contact section and the second contact section in the cross direction are the length in the cross direction of media anticipated to be used, or a longer length. This thereby enables deformation of the medium supporting section to be suppressed over the region supporting the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Detailed explanation follows regarding a recording apparatus serving as a liquid ejecting apparatus according to an embodiment of the invention, with reference to the appended drawings.

First Embodiment

FIG. 1 to FIG. 9

Explanation first follows regarding an outline of a recording apparatus 1 according to a first embodiment of the invention. The recording apparatus 1 is a recording apparatus capable of recording on a recording medium P by ejecting water based ink, however there is no limitation to a recording apparatus capable of employing a water based ink.

Figure 1:
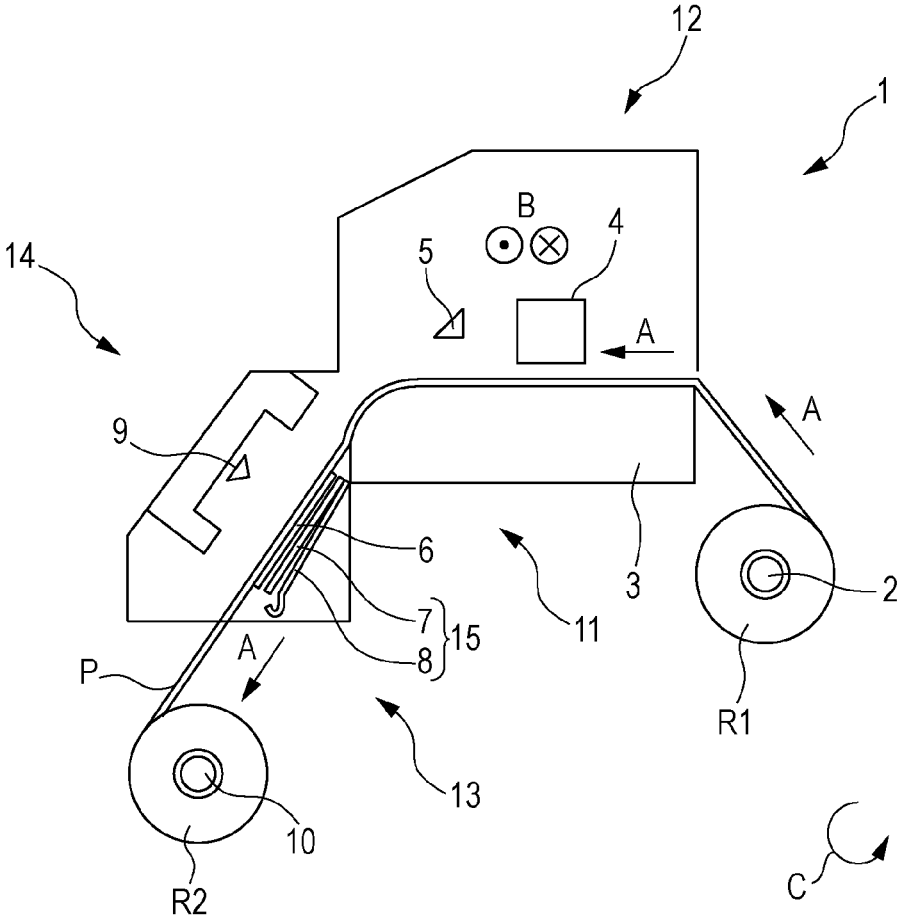
FIG. 1 is a schematic side view illustrating a recording apparatus of a first embodiment of the invention.

FIG. 1 is a schematic side view illustrating the recording apparatus 1 of the present embodiment.

The recording apparatus 1 of the present embodiment includes a recording medium P setting section 2 capable of feeding a roll R1 of the recording medium P for recording. The recording apparatus 1 of the present embodiment is configured capable of recording on the roll-form recording medium P. However there is no limitation to such a configuration, and a configuration capable of recording on cut-form recording medium P may be employed. When a configuration capable of recording on cut-form recording medium P is employed, for example, what are referred to as a paper supply (feed) tray or a paper supply (feed) cassette, may be employed as the setting section 2 for the recording medium P. Moreover, although the recording apparatus 1 includes a take-up section 10 as a collection section for the recording medium P, for example, what are referred to as an output receiver, paper discharge tray, or paper discharge cassette may be employed as the collection section instead of the take-up section 10.

In the present embodiment, since the roll-form recording medium P wound with its recording face on the outside is employed, a rotation shaft of the setting section 2 rotates in rotation direction C when the recording medium P is fed out from the setting section 2. However, when roll-form recording medium P wound with its recording face on the inside is employed, configuration may be made such that the rotation shaft of the setting section 2 rotates in the opposite direction to the rotation direction C to feed out from the roll R1.

Similarly, a rotation shaft of the take-up section 10 also rotates in the rotation direction C due to the recording medium P being wound with its recording face on the outside in the take-up section 10 of the present embodiment. However, when wound with the recording face on the inside, configuration may be made such that the rotation shaft of the take-up section 10 rotates in the opposite direction to the rotation direction C for take up.

The recording apparatus 1 of the present embodiment includes, at a platen 3, a transporting section 11 including plural transport rollers, not illustrated in the drawings, that transport the roll-form recording medium P along transporting direction A.

The recording apparatus 1 of the present embodiment includes a recording mechanism 12 that moves a recording head 4 reciprocally, serving as a liquid ejecting section, and records in a cross direction B that intersects with the transporting direction A of the recording medium P. The recording head 4 ejects ink onto the recording medium P. An image is formed (recorded) on the recording medium P by the ink ejected from the recording head 4.

Although the recording apparatus 1 of the present embodiment includes the recording head 4 that records by moving reciprocally, a recording apparatus may be employed that includes what is referred to as a line head, provided along the cross direction B intersecting with the transporting direction A with multiple nozzles to eject ink.

Reference here to a "line head" means a recording head having a nozzle region that is formed in the cross direction B intersecting with the transporting direction A of the recording medium P and that is provided so as to be capable of covering the entire cross direction B of the recording medium P. The line head is employed in a recording apparatus that forms an image by fixing one out of the recording head or the recording medium P, and moving the other thereof. The cross direction B nozzle region of a line head does not need to be capable of covering the cross direction B for all recording media P compatible with the recording apparatus.

An infrared heater 5 is provided in the recording mechanism 12 to dry the ink ejected from the recording head 4.

The wavelength of the infrared radiation of the infrared heater 5 is from 0.76 μm to 1000 μm. Infrared radiation is normally further categorized by wavelength into near-infrared radiation, mid-infrared radiation, and far-infrared radiation. Although there are various definitions of these categories, the approximate respective wavelength ranges thereof are from 0.78 μm to 2.5 μm, from 2.5 μm to 4.0 μm, and from 4.0 μm to 1000 μm. Mid-infrared radiation is preferably employed therefrom.

The recording apparatus 1 of the present embodiment includes a medium supporting device 13 at the downstream side of the recording head 4 in the transporting direction A of the recording medium P. The medium supporting device 13 includes a medium supporting section 6 of flexible mesh form, and a condensation guide section 15 including a first condensation guide section 7 and a second condensation guide section 8 that serve as a supporting base supporting the medium supporting section 6 in contact with a first contact section 27 and a second contact section 22 (see FIG. 4). The medium supporting device 13 is explained in detail below.

The recording apparatus 1 of the present embodiment includes, at a position facing the medium supporting section 6, a drying mechanism 14 that heats and dries ink ejected onto the recording medium P transported in the medium supporting section 6 using an infrared heater 9 as a heating section. Although the infrared heater 9 is employed as a heating section in the recording apparatus 1 of the present embodiment, there is no particular limitation to the configuration of the heating section.

As described above, the take-up section 10 is provided at the downstream side of the drying mechanism 14 in the transporting direction A of the recording medium P, and is capable of taking up the recording medium P in the form of a roll R2.

Detailed explanation next follows regarding the medium supporting device 13.

Figure 2:
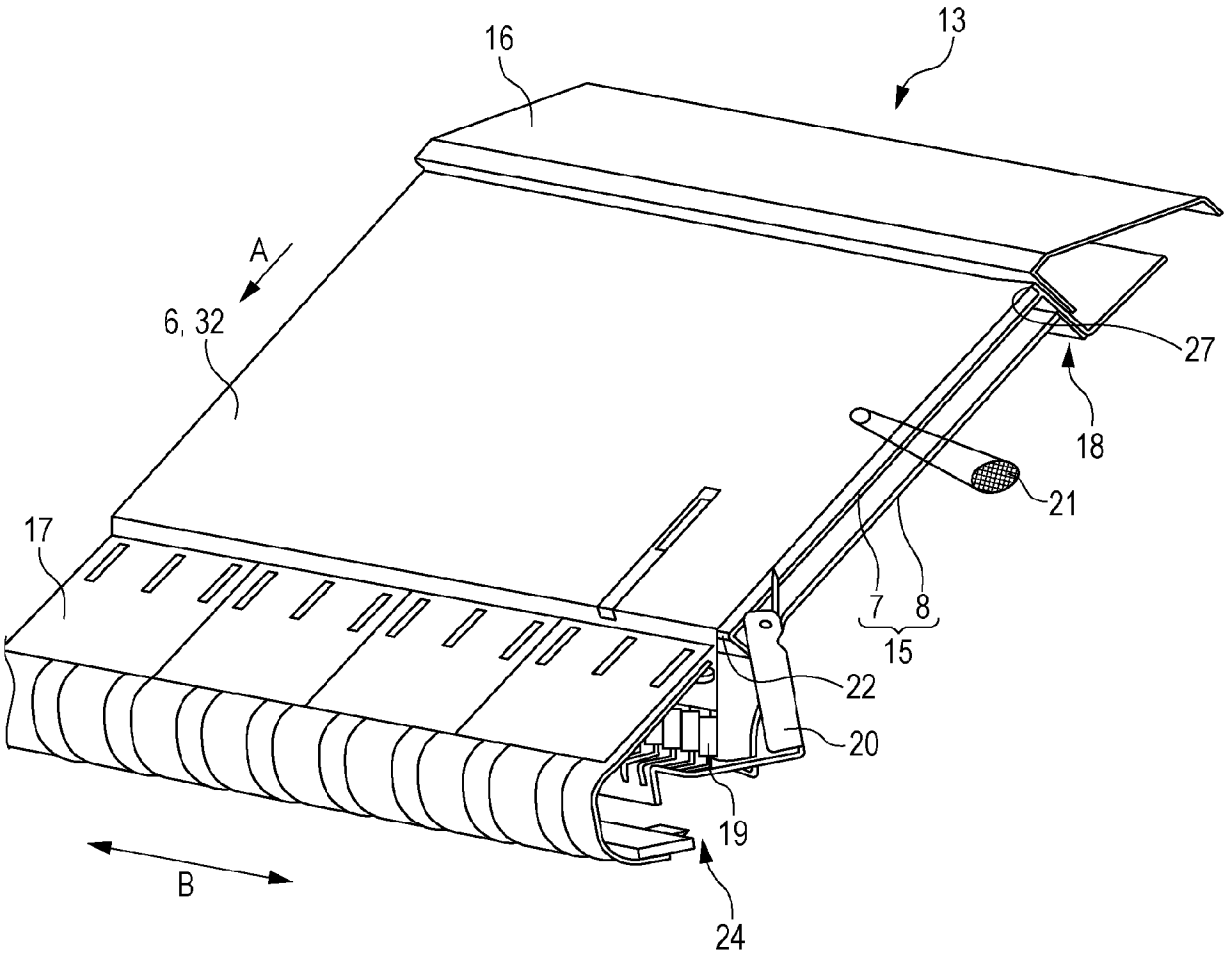
FIG. 2 is a schematic perspective view illustrating a medium supporting device of a recording apparatus of the first embodiment of the invention, as viewed from the side of a medium supporting section.
Figure 3:
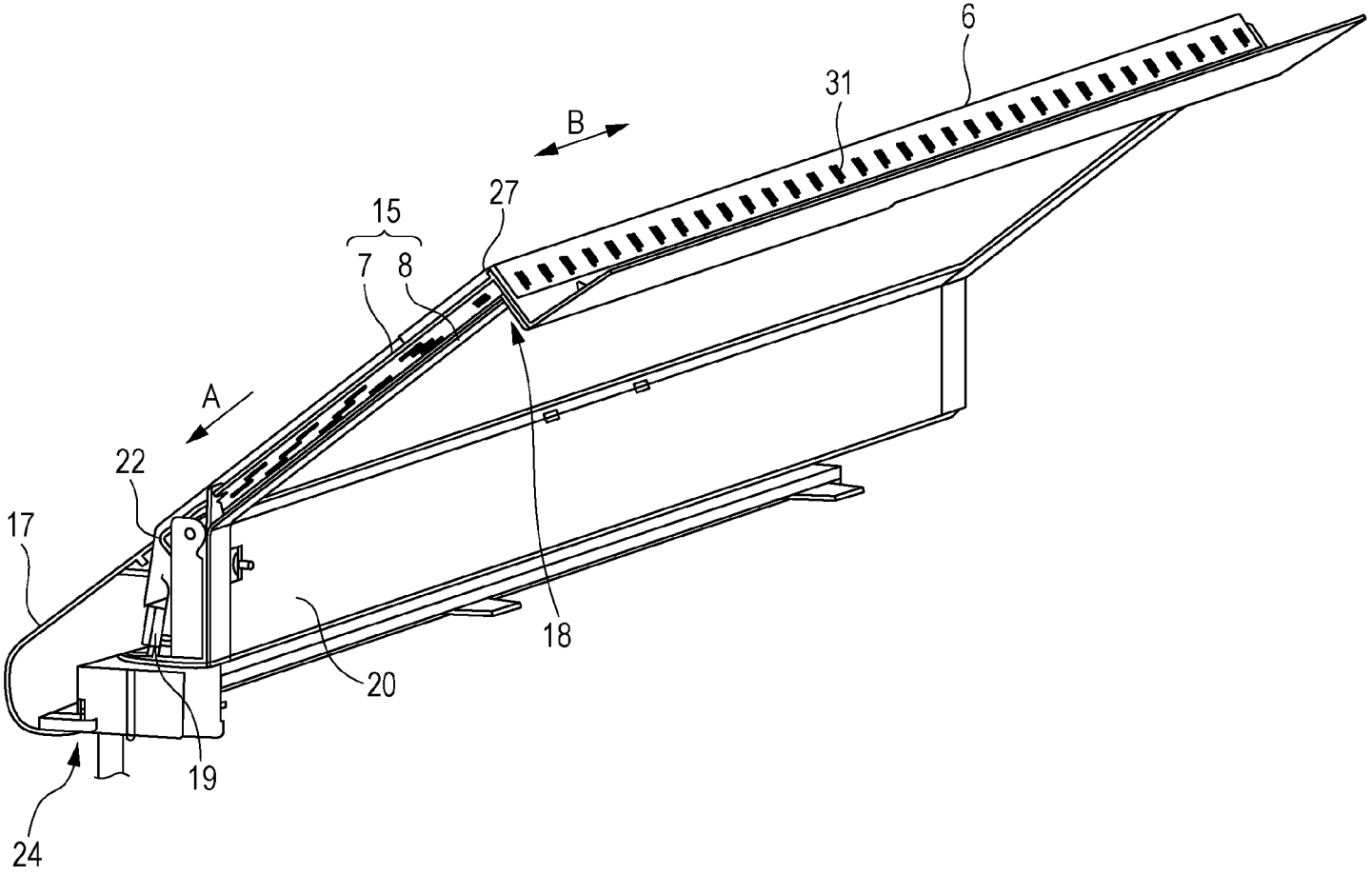
FIG. 3 is a schematic perspective view illustrating a medium supporting device of a recording apparatus of the first embodiment of the invention, as viewed from the side of a condensation guide section.
Figure 4:
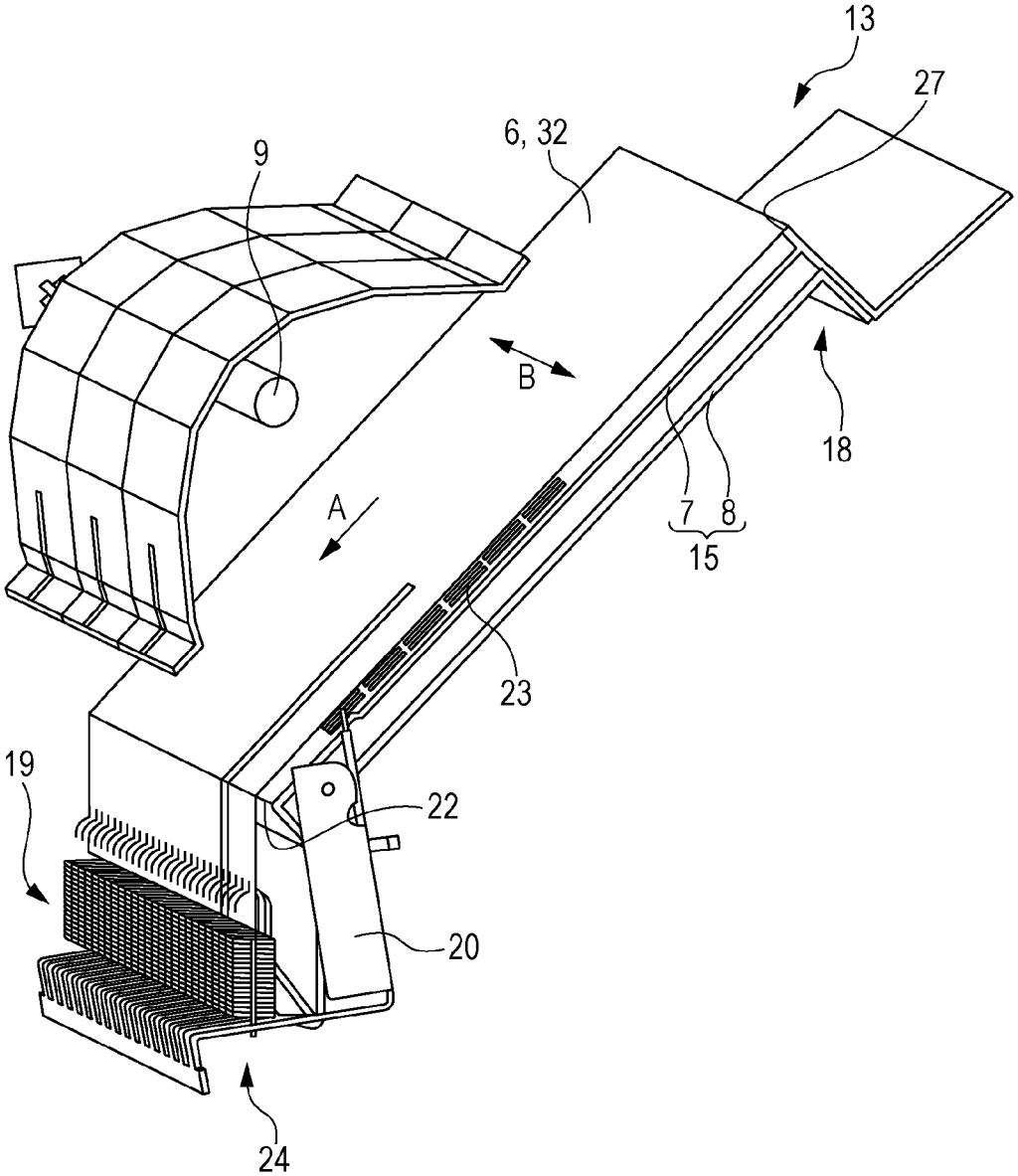
FIG. 4 is a schematic perspective view illustrating a medium supporting device of a recording apparatus of the first embodiment of the invention, as viewed from the side of a medium supporting section.
Figure 5:
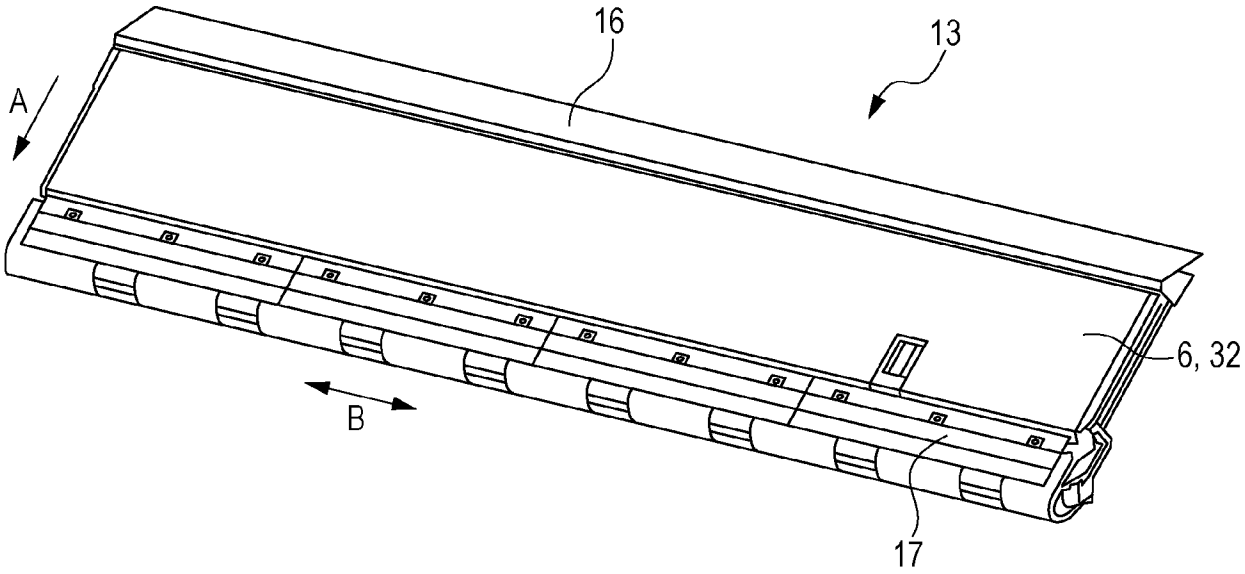
FIG. 5 is a schematic perspective view illustrating a medium supporting device of a recording apparatus of the first embodiment of the invention, as viewed from the side of a medium supporting section.
Figure 6:
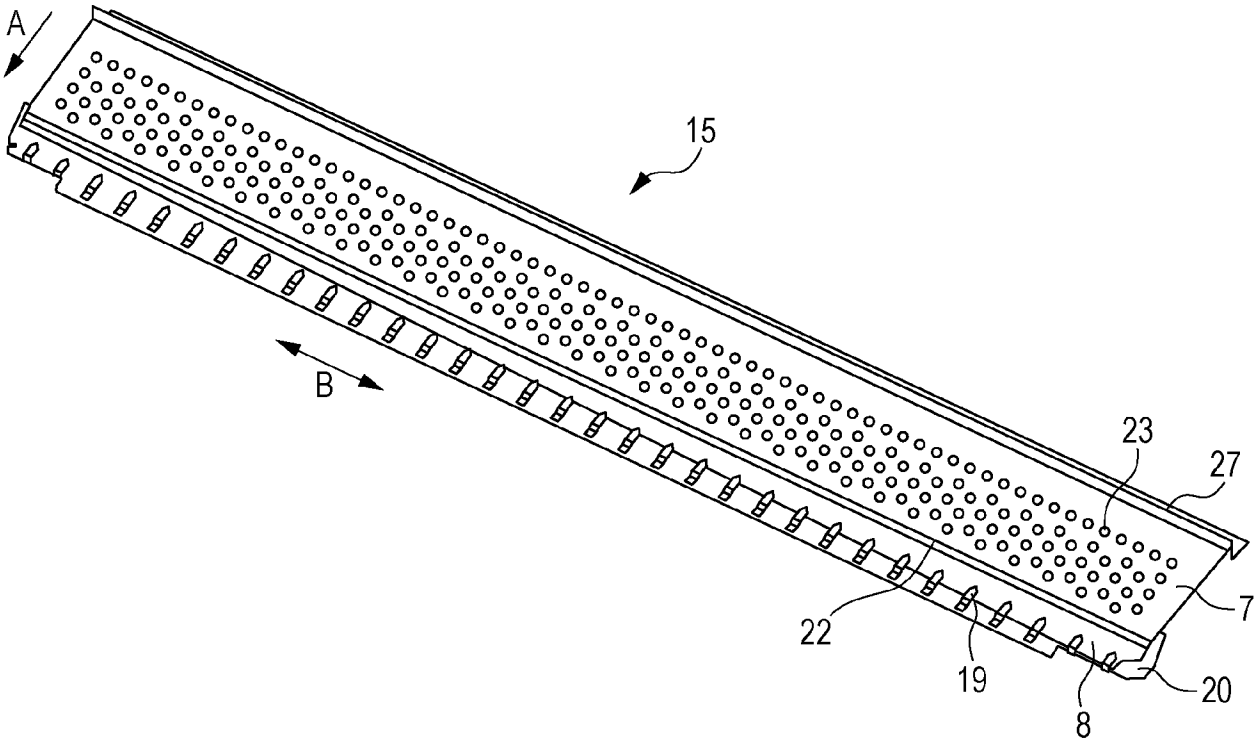
FIG. 6 is a schematic perspective view illustrating a condensation guide section of a recording apparatus of the first embodiment of the invention.
Figure 7:
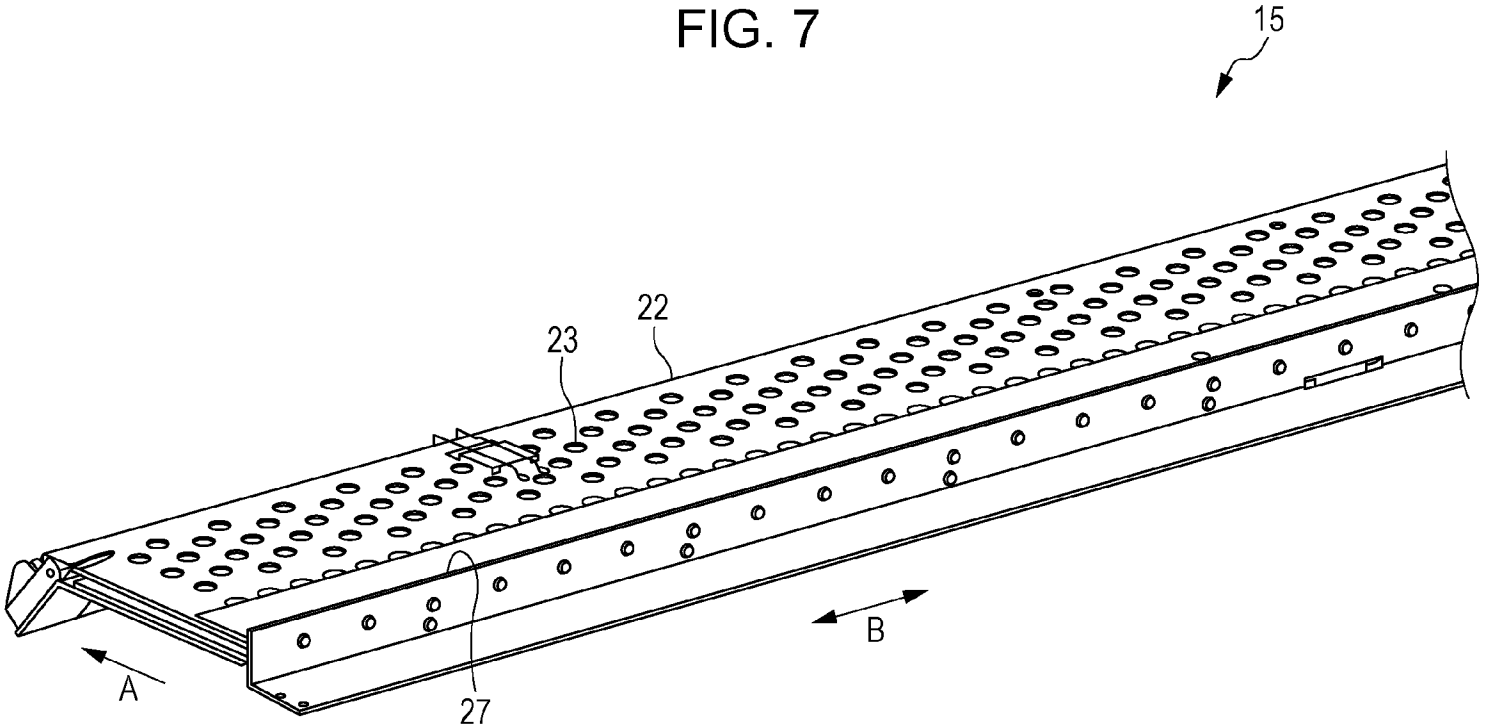
FIG. 7 is a schematic perspective view illustrating a condensation guide section of a recording apparatus of the first embodiment of the invention.

FIG. 2, FIG. 4, and FIG. 5 are schematic perspective views illustrating the medium supporting device 13 in the recording apparatus 1 of the present embodiment, as viewed from the medium supporting section 6 side (diagonally from above). FIG. 3 is a schematic perspective view illustrating the medium supporting device 13 in the recording apparatus 1 of the present embodiment, as viewed from the condensation guide section 15 side (diagonally from below). FIG. 6 is a schematic perspective view illustrating the condensation guide section 15 of the present embodiment, as viewed from the front face side. FIG. 7 is a schematic perspective view illustrating the condensation guide section 15 of the present embodiment, as viewed from the back face side.

As illustrated in FIG. 2 and FIG. 5, the medium supporting device 13 of the present embodiment includes a fixed member 16 that performs the role of a medium supporting section at the upstream side in the transporting direction A, and is fixed to the medium supporting section 6. The medium supporting device 13 also includes a fixed member 17 that performs the role of a medium supporting section at the downstream side in the transporting direction A and that is fixed to the medium supporting section 6. FIG. 3 illustrates a state in which the fixed member 16 has been removed, and FIG. 4 illustrates a state in which both the fixed member 16 and the fixed member 17 have been removed.

As illustrated in FIG. 2, FIG. 3, and FIG. 4, at the upstream side in the transporting direction A, the medium supporting section 6, the first condensation guide section 7, and the second condensation guide section 8 are fastened together by a fastening section 18 and connected to the housing of the recording apparatus 1. Thus at the upstream side of the medium supporting section 6 in the transporting direction A, heat from the infrared heater 9 readily flows from the medium supporting section 6 to the first condensation guide section 7, the second condensation guide section 8, and the housing of the recording apparatus 1, such that high temperatures do not readily arise. There is, however, no limitation to such a configuration, and a configuration may be adopted in which the medium supporting section 6, the first condensation guide section 7, and the second condensation guide section 8 are not fastened together at the upstream side in the transporting direction A.

As illustrated in FIG. 2, FIG. 3, and FIG. 4, the first condensation guide section 7 supports the flexible medium supporting section 6 in contact with the first contact section 27 and the second contact section 22. Plural springs 19, configuring a tension applying section 24 that applies tension in the transporting direction A to the medium supporting section 6 between the first contact section 27 and the second contact section 22, are also provided to the medium supporting device 13 of the present embodiment. As illustrated in FIG. 6 and FIG. 7, the first contact section 27 and the second contact section 22 extend in straight lines in the cross direction B, intersecting with the tension applying direction.

Reference here to "the first contact section 27 and the second contact section 22 extend in straight lines in the cross direction B, intersecting with the tension applying direction" means a configuration in which the first contact section 27 and the second contact section 22 have substantially no unevenness along the cross direction B, so as not to cause deformation of the medium supporting section 6.

The first contact section 27 and the second contact section 22 extend in straight lines in the cross direction B, such that the medium supporting section 6 contacts the first contact section 27 and the second contact section 22 and is applied with tension either at a straight line, or a flat plane, extending along the cross direction B. A flat medium support face 32 is accordingly formed to the medium supporting section 6.

The medium supporting section 6 is accordingly suppressed from supporting the recording medium P in a deformed state.

More precisely, the first contact section 27 is configured by a protrusion extending in a straight line along the cross direction B, and the second contact section 22 is configured as a bent portion of the first condensation guide section 7 extending in a straight line along the cross direction B.

In the present embodiment a configuration is adopted in which one configuration member extends in a straight line along the cross direction B as configuration extending in a straight line along the cross direction B, however a configuration may be adopted with plural configuration members, each extending in a straight line along the cross direction B, arranged in a row along the cross direction B. It is preferable that there are no gaps between each of the configuration members when plural configuration members are arranged in a row along the cross direction B, however there may be gaps present as long as they are gaps of a size that does not cause deformation of the medium supporting section 6.

As illustrated in FIG. 4, the tension applying section 24 of the medium supporting device 13 of the present embodiment is configured with the springs 19 that are elastic members in a row along the cross direction B.

This thereby achieves a configuration in which the medium supporting section 6 is tensioned over a wide range in the cross direction B, thereby configuring, both simply and at low cost, the tension applying section 24 capable of suppressing deformation of the medium supporting section 6.

As illustrated in FIG. 2, the medium supporting section 6 of the present embodiment is of mesh form, with multiple holes 21 present therein. Configuring the medium supporting section 6 in a mesh form makes it readily deformable. However the medium supporting device 13 of the present embodiment is configured with the flat medium support face 32 on the medium supporting section 6 by applying tension to the medium supporting section 6 between the first contact section 27 and the second contact section 22, thereby suppressing the medium supporting section 6 from supporting the recording medium P in a deformed state.

The medium supporting section 6 is configured in a mesh form with multiple holes 21 to allow ink that has been evaporated by heating with the infrared heater 9 to escape to the condensation guide section 15. There are also holes 23 provided in the first condensation guide section 7 to allow the evaporated ink to also escape to the second condensation guide section 8.

As described above, the recording apparatus 1 of the present embodiment includes the transporting section 11 that transports the recording medium P, the recording head 4 that ejects ink onto the recording medium P being transported by the transporting section 11, and the medium supporting device 13 that uses the medium supporting section 6 to support the recording medium P onto which ink has been ejected. The direction in which tension is applied is a direction along the transporting direction A of the recording medium P.

Generally speaking, in a recording apparatus equipped with a transporting section 11, such as the recording apparatus 1 of the present embodiment, the transportation precision is particularly lowered when deformation extending along the cross direction B intersecting with the transporting direction A occurs in the medium supporting section 6. This is due to the recording medium P being liable to catch on the deformed portion.

However, in the recording apparatus 1 of the present embodiment, the direction in which tension is applied is a direction along the transporting direction A, resulting in a configuration capable of particularly effectively suppressing deformation extending along the cross direction to the transporting direction A from being caused in the medium supporting section 6.

As described above, the recording apparatus 1 of the present embodiment includes the infrared heater 9 capable of heating the recording medium P onto which ink is ejected and which is supported by the medium supporting section 6. The springs 19 configuring the tension applying section 24 also apply tension from the downstream side in the transporting direction A.

Generally speaking, in a recording apparatus 1 provided with a recording head 4 and an infrared heater 9 such as the recording apparatus 1 of the present embodiment, ink evaporated by heat from the infrared heater 9 sometimes causes condensation, with condensation particularly liable to occur at the upstream side of the medium supporting section 6 in the transporting direction A. This is because transporting the heated recording medium P results in the downstream side being warmed by the heated recording medium P more than the upstream side, raising the temperature thereof.

However, the recording apparatus 1 of the present embodiment has a configuration in which the springs 19 configuring the tension applying section 24 apply tension from the downstream side in the transporting direction A. Namely, the springs 19 are provided at the downstream side of the medium supporting section 6 in the transporting direction A. Condensation on the springs 19 is accordingly suppressed from developing due to the springs 19 being provided at the downstream side in the transporting direction A.

As illustrated in FIG. 3, the upstream side of the medium supporting section 6 in the transporting direction A is fixed to the first condensation guide section 7 at the fastening section 18 by plural springs 31 provided in a row along the cross direction B.

In the recording apparatus 1 of the present embodiment, the lengths in the cross direction B of the first contact section 27 and the second contact section 22 are configured to be the length in the cross direction B over which ink is ejectable by the recording head 4, or a longer length. Namely, the lengths of the first contact section 27 and the second contact section 22 in the cross direction B are the length in the cross direction B of recording media P anticipated to be used, or a longer length.

This thereby suppresses deformation of the medium supporting section 6 in the region supporting the recording medium P, thereby suppressing recording medium P transportation issues.

Explanation next follows regarding the tension applying section 24 of the recording apparatus 1 of the present embodiment.

Figure 8:
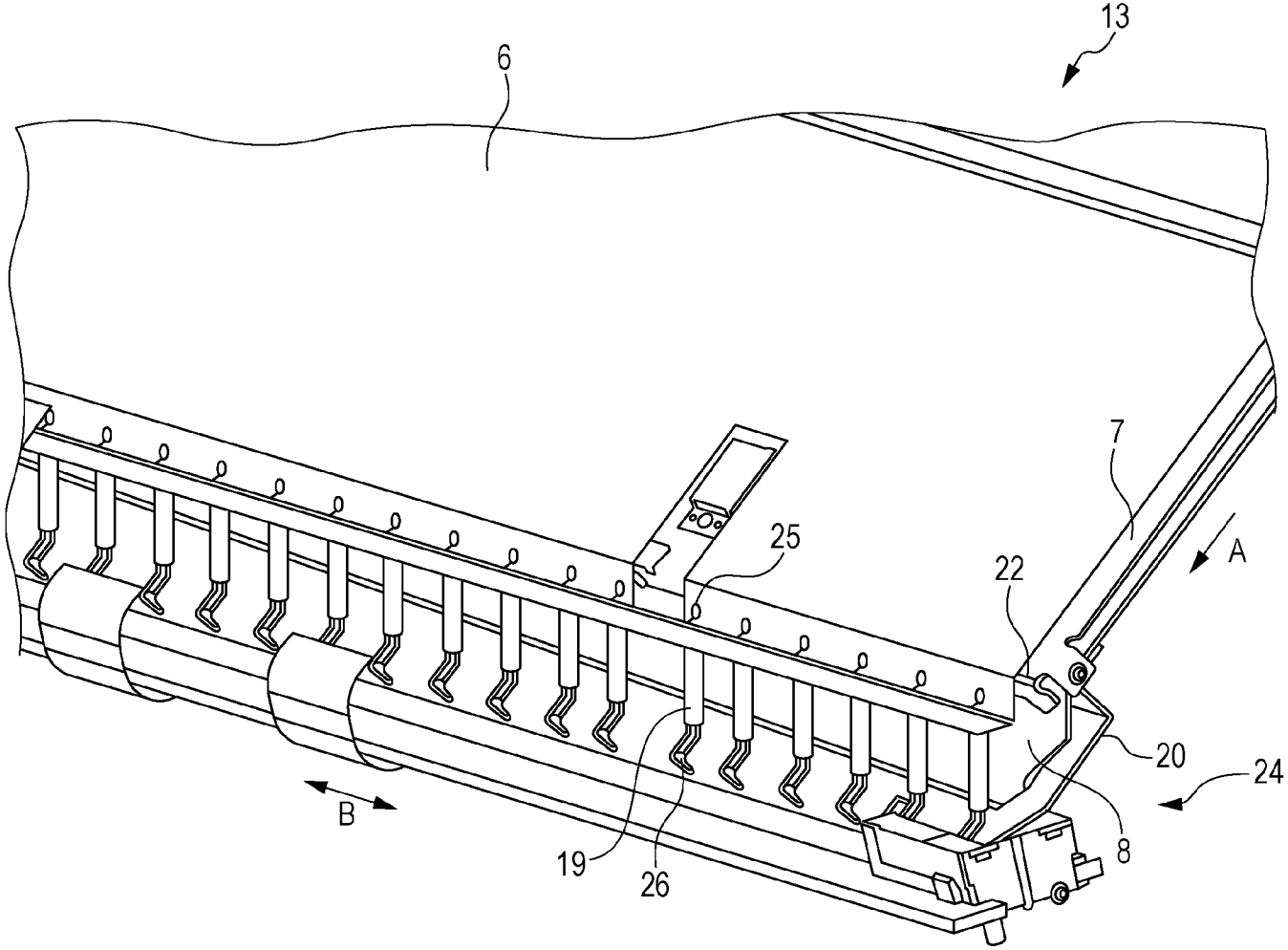
FIG. 8 is a schematic perspective view illustrating a medium supporting device of a recording apparatus of the first embodiment of the invention.
Figure 9:
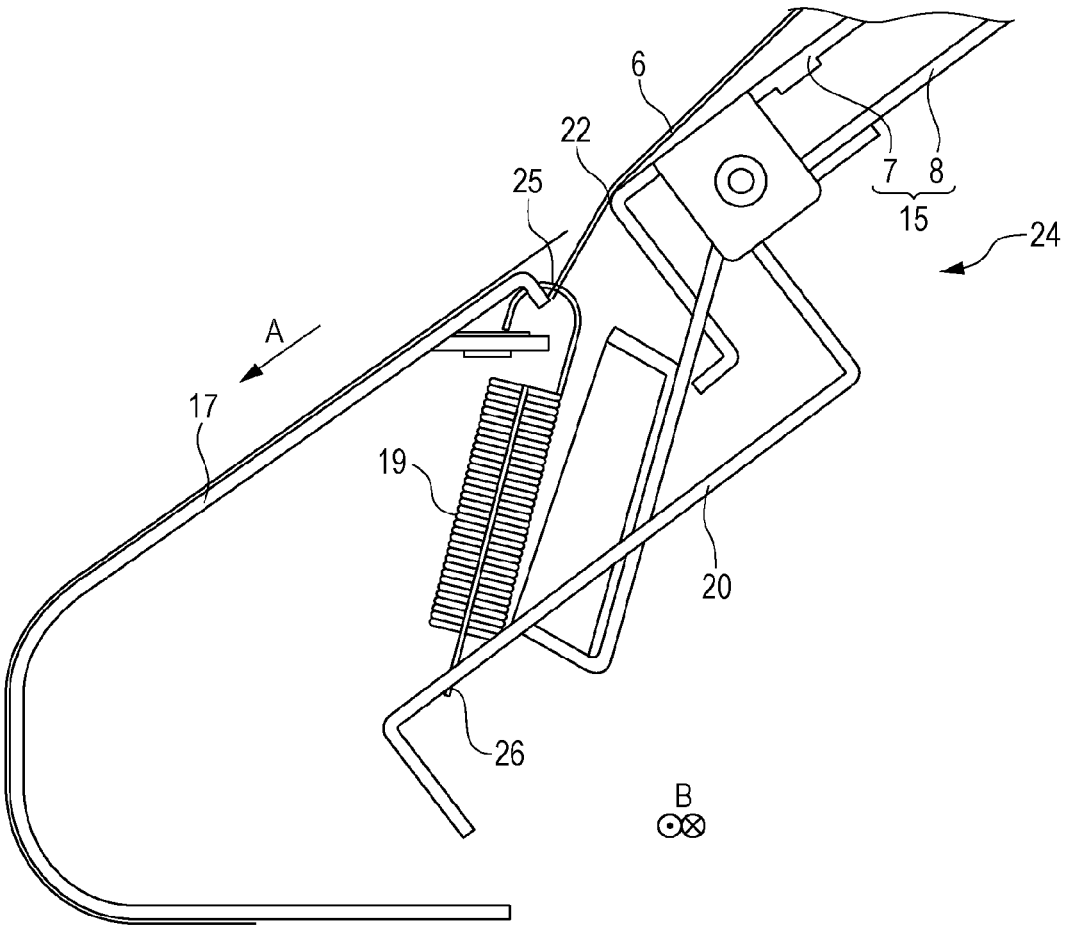
FIG. 9 is a schematic side cross-section illustrating a tension applying section of a recording apparatus of the first embodiment of the invention.

FIG. 8 is a schematic perspective view illustrating the medium supporting device 13 of the recording apparatus 1 of the present embodiment. FIG. 9 is a schematic side cross-section illustrating the tension applying section 24 of the recording apparatus 1 of the present embodiment.

As illustrated in FIG. 8, multiple holes 25 are provided along the cross direction B at an end portion of the medium supporting section 6 in the transporting direction A, and multiple holes 26 are also provided at positions aligned with the holes 25 in a reinforcement member 20 of higher rigidity than the medium supporting section 6. Moreover, as illustrated in FIG. 8 and FIG. 9, the springs 19 connect the medium supporting section 6 and the reinforcement member 20 together by hooking into the holes 25 and the holes 26.

The medium supporting section 6 is thereby placed in contact with the second contact section 22, this being a ridge portion at the transporting direction A downstream side end of the first condensation guide section 7.

Second Embodiment

FIG. 10

Detailed explanation next follows regarding a recording apparatus of a second embodiment, with reference to the appended drawings.

Figure 10:
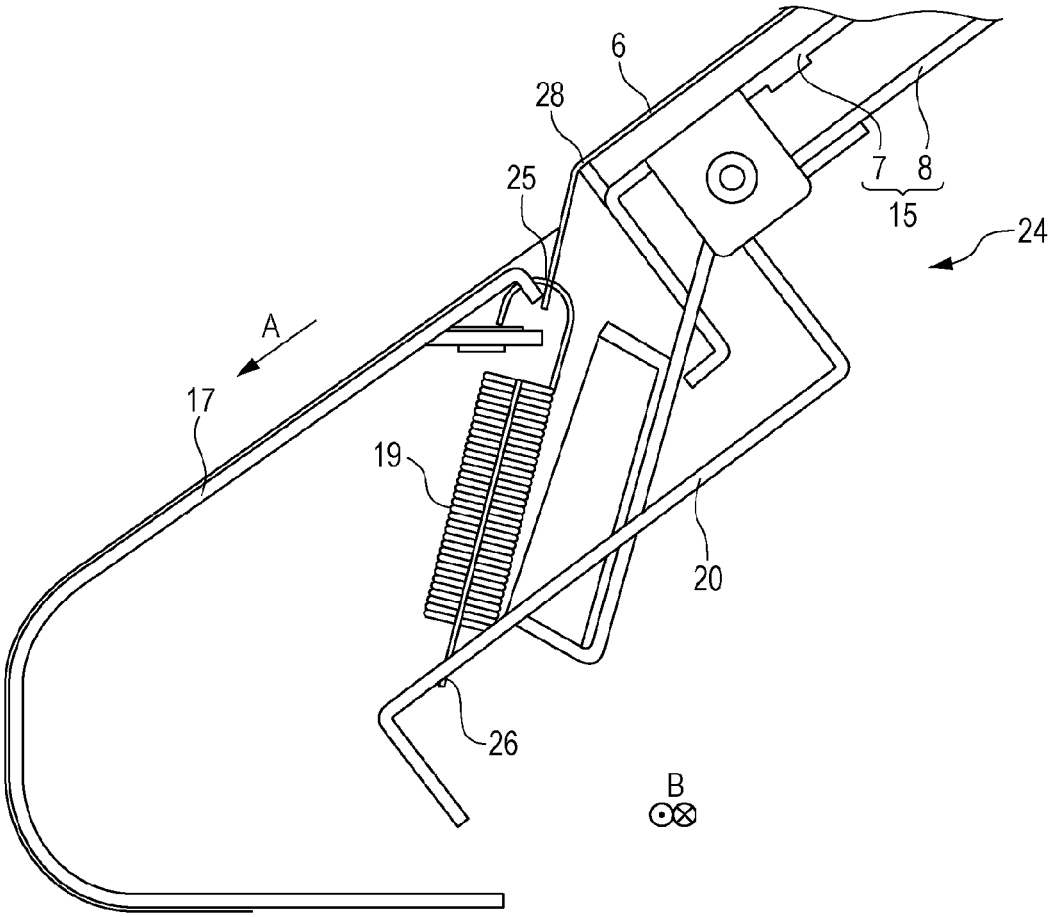
FIG. 10 is a schematic side cross-section illustrating a tension applying section of a recording apparatus of a second embodiment of the invention.

FIG. 10 is a schematic side cross-section illustrating a medium supporting device 13 of a recording apparatus 1 of the present embodiment. Configuration members common to the above embodiment are allocated the same reference numerals, and detailed explanation will be omitted thereof.

Configuration of the recording apparatus 1 of the present embodiment is similar to that of the recording apparatus 1 of the first embodiment, except in that a second contact section 28 configured by a protrusion extending in a straight line along the cross direction B is provided in place of the second contact section 22 configured by the bent portion of the first condensation guide section 7 extending in a straight line in the cross direction B.

Third Embodiment

FIG. 11

Detailed explanation next follows regarding a recording apparatus of a third embodiment, with reference to the appended drawings.

Figure 11:
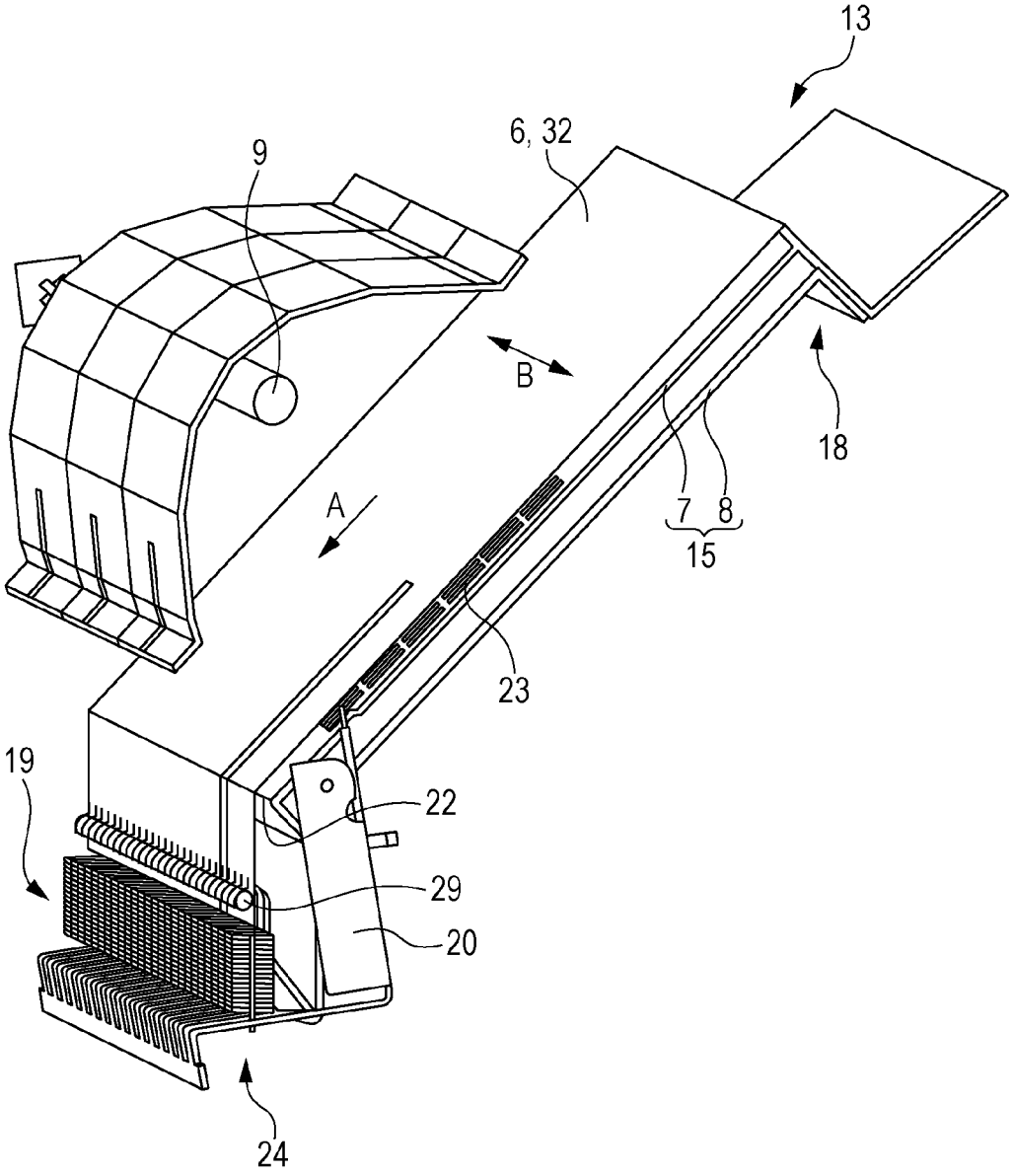
FIG. 11 is a schematic perspective view illustrating a medium supporting device of a recording apparatus of a third embodiment of the invention, as viewed from the side of a medium supporting section.

FIG. 11 is a schematic perspective view of a medium supporting device 13 of a recording apparatus 1 of the present embodiment, as viewed from the side of a medium supporting section 6. Configuration members common to the above embodiments are allocated the same reference numerals, and detailed explanation will be omitted thereof.

The recording apparatus 1 of the present embodiment is configured similarly to the recording apparatus 1 of the first embodiment, except in that a reinforcement member 29 extending in the cross direction B is provided to a tension applying section 24.

As illustrated in FIG. 11, the medium supporting device 13 of the present embodiment includes the reinforcement member 29 extending in the cross direction B. Springs 19 are configured so as to be capable of applying tension to the medium supporting section 6 by tensioning the medium supporting section 6 together with the reinforcement member 29.

Due to adopting such a configuration, the medium supporting device 13 of the present embodiment makes it possible to tension the medium supporting section 6 with force uniform along the cross direction B using the springs 19, enabling a flat medium support face 32 to be efficiently configured on the medium supporting section 6. The medium supporting section 6 is thereby effectively suppressed from supporting the recording medium P in a deformed state.

Fourth Embodiment

FIG. 12

Detailed explanation follows regarding a recording apparatus of a fourth embodiment, with reference to the appended drawings.

Figure 12:
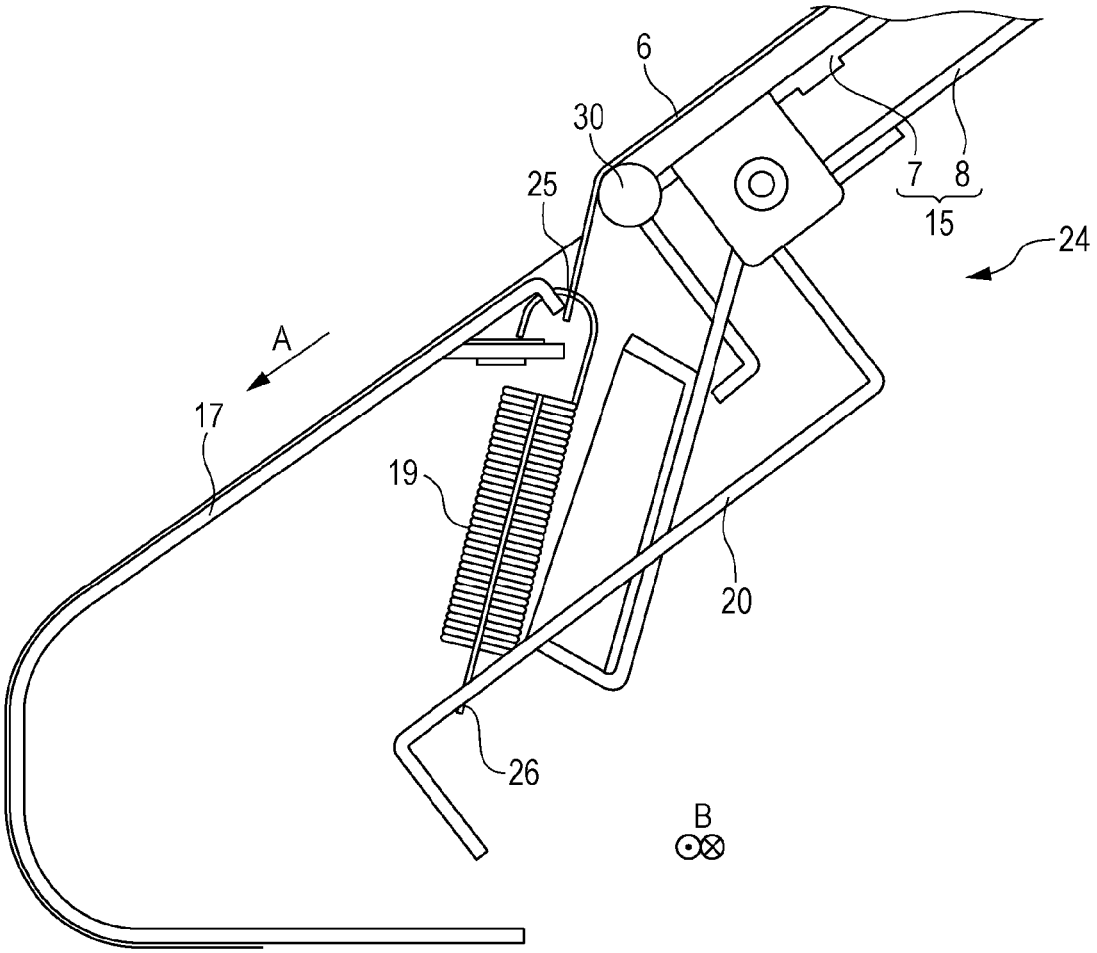
FIG. 12 is a schematic side cross-section illustrating a tension applying section of a recording apparatus of a fourth embodiment of the invention.

FIG. 12 is a schematic side cross-section illustrating a medium supporting device 13 of a recording apparatus 1 of the present embodiment. Configuration members common to the above embodiments are allocated the same reference numerals, and detailed explanation will be omitted thereof The recording apparatus 1 of the present embodiment is configured similarly to the recording apparatus 1 of the first embodiment, except in that a second contact section 30 formed in a circular cylinder shape extending in a straight line along the cross direction B is provided in place of the second contact section 22 configured by the bent portion of the first condensation guide section 7 extending in a straight line in the cross direction B.

As illustrated in FIG. 12, in the medium supporting device 13 of the present embodiment the second contact section 30 is provided as a circular cylinder shape extending in a straight line along the cross direction B. The medium supporting section 6 accordingly contacts the second contact section 30 at a curved face of the circular cylinder shape, thereby suppressing contact with an acute angled portion or the like liable to generate wear. Wear of the medium supporting section 6 is accordingly suppressed.

Whereas in the medium supporting device 13 of the present embodiment it is only the second contact section 30 that is formed in a circular cylinder shape extending in a straight line along the cross direction B, configuration may be adopted in which only the first contact section is configured in a circular cylinder shape extending in a straight line along the cross direction B, or configuration may be adopted in which both the first contact section and the second contact section are each configured in a circular cylinder shape extending in a straight line along the cross direction B.

The entire disclosure of Japanese Patent Application No. 2014-036404, filed Feb. 27, 2014 is expressly incorporated reference herein.

What is claimed is:

1. A medium supporting device comprising:

a flexible medium supporting section that supports a medium;

a condensation guide section that includes a first condensation guide portion and a second condensation guide portion that each contact and support the flexible medium supporting section, wherein the first condensation portion allows evaporated liquid to pass through to the second condensation guide portion, the second condensation guide portion collecting the passed liquid; and a tension applying section that applies tension to the medium supporting section between a first contact section and a second contact section, wherein the first contact section and the second contact section extend in a cross direction, intersecting with a tension applying direction.

2. The medium supporting device according to claim 1, wherein the tension applying section includes elastic members provided in a row along the cross direction.

3. The medium supporting device according to claim 2, further comprising a reinforcement member extending along the cross direction, wherein the elastic members are configured capable of applying tension to the medium supporting section by tensioning the medium supporting section together with the reinforcement member.

4. A liquid ejecting apparatus comprising:

a transporting section that transports a medium;

a liquid ejecting section that ejects liquid onto the medium being transported by the transporting section; and the medium supporting device according to claim 3 that uses the medium supporting section to support the medium onto which the liquid has been ejected, wherein the tension applying direction is a direction along a transporting direction of the medium.

5. A liquid ejecting apparatus comprising:

a transporting section that transports a medium;

a liquid ejecting section that ejects liquid onto the medium being transported by the transporting section; and the medium supporting device according to claim 2 that uses the medium supporting section to support the medium onto which the liquid has been ejected, wherein the tension applying direction is a direction along a transporting direction of the medium.

6. The medium supporting device according to claim 1, wherein a configuration member configuring at least one of the first contact section and the second contact section is formed in a circular cylinder shape extending along the cross direction.

7. A liquid ejecting apparatus comprising:

a transporting section that transports a medium;

a liquid ejecting section that ejects liquid onto the medium being transported by the transporting section; and the medium supporting device according to claim 6 that uses the medium supporting section to support the medium onto which the liquid has been ejected, wherein the tension applying direction is a direction along a transporting direction of the medium.

8. The medium supporting device according to claim 1, wherein the medium supporting section has a mesh form.

9. A liquid ejecting apparatus comprising:

a transporting section that transports a medium;

a liquid ejecting section that ejects liquid onto the medium being transported by the transporting section; and the medium supporting device according to claim 8 that uses the medium supporting section to support the medium onto which the liquid has been ejected, wherein the tension applying direction is a direction along a transporting direction of the medium.

10. A liquid ejecting apparatus comprising:

a transporting section that transports a medium;

a liquid ejecting section that ejects liquid onto the medium being transported by the transporting section; and the medium supporting device according to claim 1 that uses the medium supporting section to support the medium onto which the liquid has been ejected, wherein the tension applying direction is a direction along a transporting direction of the medium.

11. The liquid ejecting apparatus according to claim 10, further comprising:

a heating section capable of heating the medium that is supported by the medium supporting section and onto which the liquid is ejected, wherein the tension applying section applies tension from the downstream side in the transporting direction of the medium.

12. The liquid ejecting apparatus according to claim 10, wherein lengths in the cross direction of the first contact section and the second contact section are a length in the cross direction over which the liquid is ejectable by the liquid ejecting section, or a longer length.

* * * * *